US010188187B1

(12) United States Patent
Smith

(10) Patent No.: US 10,188,187 B1
(45) Date of Patent: Jan. 29, 2019

(54) PURSE PROTECTING APPARATUS AND ASSOCIATED USE THEREOF

(71) Applicant: Angela Smith, Port Washington, NY (US)

(72) Inventor: Angela Smith, Port Washington, NY (US)

( * ) Notice: Subject to any disclaimer, the term of this patent is extended or adjusted under 35 U.S.C. 154(b) by 217 days.

(21) Appl. No.: 15/210,660

(22) Filed: Jul. 14, 2016

Related U.S. Application Data

(60) Provisional application No. 62/192,134, filed on Jul. 14, 2015.

(51) Int. Cl.
*A45C 13/20* (2006.01)
*A45C 3/06* (2006.01)

(52) U.S. Cl.
CPC ..... *A45C 13/20* (2013.01); *A45C 3/06* (2013.01)

(58) Field of Classification Search
CPC ..... A45C 13/18; A45C 1/024; A45C 1/04; A45C 1/00; A45C 3/06
USPC ..... 150/101–133; 224/220, 625; 190/101
See application file for complete search history.

(56) References Cited

U.S. PATENT DOCUMENTS 1,643,106 A * 9/1927 Williams ..... A45C 13/18 190/101
3,294,299 A * 12/1966 Brennan ..... A44C 19/00 224/220
5,845,833 A * 12/1998 Murphy ..... A45C 13/30 224/625
2003/0178453 A1* 9/2003 Soboleski ..... A45C 13/20 224/220
2003/0201295 A1* 10/2003 Beatto ..... A45F 5/12 224/625
2005/0056674 A1* 3/2005 Renn ..... A45C 3/06 224/625
2013/0168428 A1* 7/2013 Fujikura ..... A45C 3/04 224/626

* cited by examiner

*Primary Examiner* — Fenn C Mathew
*Assistant Examiner* — Cynthia Collado
(74) *Attorney, Agent, or Firm* — Ashkan Najafi

(57) ABSTRACT

A combined purse and security fastener includes a purse including a storage section and a flexible shoulder strap affixed thereto, and a security fastener slidably coupled to the purse. Such a security fastener includes a flexible chain and a shoulder pad adjustably engaged with the flexible chain. Advantageously, the flexible chain is looped through the flexible shoulder strap and interlinked therewith such that the flexible chain rests along a first axis during use and the flexible shoulder strap rests along a second axis during use. Notably, the first axis intersects the second axis such that the flexible chain overlaps the flexible shoulder strap.

12 Claims, 5 Drawing Sheets

PURSE PROTECTING APPARATUS AND ASSOCIATED USE THEREOF

CROSS REFERENCE TO RELATED APPLICATIONS

This is a non-provisional patent application that claims the benefit of U.S. provisional patent application No. 62/192,134 filed Jul. 14, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to safety devices and, more particularly, to a specially designed security fastener including an integrated, ergonomic sliding shoulder pad for securing the purse's shoulder straps around a user's neck and shoulder, thus effectively preventing theft of these accessories, while also affording optimal comfort when carrying the over the shoulder.

Prior Art

An indispensable accessory carried by millions of women is a purse. A purse, also known as a pocket book or handbag, can be manufactured from a variety of materials such as leather, straw, canvas or silk and is designed to efficiently store a woman's personal belongings. Manufactured in a variety of sizes, colors and styles, all intended to appeal to the individual needs of the consumer; purses are used for everything from carrying an extra tube of lipstick to storing wallets, cellular telephones, important papers and even extra clothing. Regardless of whether one is clutching a fancy beaded evening bag, a practical and stylish midsize purse, or a bulky, oversized tote loaded with enough supplies to last a month, for most women, a purse is the one necessity they will never leave home without.

Although there is little dispute that purses are practical and necessary items, use of one is not without drawbacks. Specifically, a purse loaded with personal goods can be a prized target of any would-be thief. Experienced criminals can run by a potential victim, literally ripping their purse off the victim's shoulder and snatching the bag before the victim even realizes what is happening. Considering the plethora of personal items including cash, credit cards, bank cards and identification stored inside a purse, the theft of a handbag can be an emotionally and financially devastating experience.

In addition to the serious threat of having one's purse snatched, another challenge associated with purses has to actually carrying these accessories. Weighted down by the objects stored within, a purse can easily slide off the user's shoulder, requiring them to repeatedly stop what they are doing in order to reposition this accessory. Many women find that even purses that are only lightly packed with goods can be difficult to carry after an extended period. Digging into the tender flesh off the shoulder, the straps of a purse can cause extreme discomfort, resulting in stiff and sore shoulder, neck and back muscles. Not limited to purses, these scenarios are also true of such carryalls as briefcases, gym bags and even laptop bags and thus can be encountered by men as well as women.

Accordingly, a need remains for a specially designed security fastener in order to overcome at least one aforementioned shortcoming. The exemplary embodiment(s) satisfy such a need by providing a specially designed security fastener including an integrated, ergonomic sliding shoulder pad for securing the purse's shoulder straps around a user's neck and shoulder, that is convenient and easy to use, lightweight yet durable in design, versatile in its applications, and designed for effectively preventing theft of these accessories, while also affording optimal comfort when carrying the over the shoulder.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a combined purse and security fastener for securing the purse around a user neck and a user shoulder, thus preventing theft of the purse, while also affording optimal comfort when carrying the purse over the user shoulder. Such a combined purse and security fastener includes a purse including a storage section and a flexible shoulder strap affixed thereto, and a security fastener slidably coupled to the purse. Such a security fastener includes a flexible chain and a shoulder pad adjustably engaged with the flexible chain. Advantageously, the flexible chain is looped through the flexible shoulder strap and interlinked therewith such that the flexible chain rests along a first axis during use and the flexible shoulder strap rests along a second axis during use. Notably, the first axis intersects the second axis such that the flexible chain overlaps the flexible shoulder strap.

In a non-limiting exemplary embodiment, the flexible chain includes a plurality of interlinked rings disposed non-parallel to the flexible shoulder strap during use, a first fastener attached to a proximal end of the interlinked rings, and a second fastener attached to a distal end of the interlinked rings. Advantageously, the first fastener is releasably engaged with the second fastener. Notably, the interlinked rings are configured to form a loop when the first fastener is affixed to the second fastener.

In a non-limiting exemplary embodiment, the second axis is substantially vertical and the first axis is angled approximately 45 degrees relative to the second axis.

In a non-limiting exemplary embodiment, the shoulder pad is slidably reciprocated in a bidirectional path along a longitudinal length of the interlinked rings.

In a non-limiting exemplary embodiment, the first axis passes through the shoulder pad during use.

In a non-limiting exemplary embodiment, the second axis passes through the storage section during use.

The present disclosure further includes a method of utilizing a combined purse and security fastener for securing the purse around a user neck and a user shoulder, thus preventing theft of the purse, while also affording optimal comfort when carrying the purse over the user shoulder. Such a method includes the chronological steps of: providing a purse including a storage section and a flexible shoulder strap affixed thereto; carrying the flexible shoulder strap over a first shoulder of the user such that a weight of the purse is supported on the first shoulder of the user; providing a security fastener including a flexible chain and a shoulder pad adjustably engaged with the flexible chain; lifting each of the flexible chain and the shoulder pad up and over a user neck opposite to the first shoulder of the user; and resting the shoulder pad on a second shoulder of the user opposite to the first shoulder of the user such that a weight of the security fastener is supported on the second shoulder of the user.

The method further includes the chronological steps of: slidably coupling the security fastener to the flexible shoulder strap by looping a proximal end of the flexible chain through the flexible shoulder strap while holding a distal end of the flexible chain adjacent to the storage section; and fastening the proximal end of the flexible chain to the distal end of the flexible chain such that the flexible chain rests along a first axis during use and the flexible shoulder strap rests along a second axis during use, wherein the first axis intersects the second axis, wherein the flexible chain overlaps the flexible shoulder strap.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
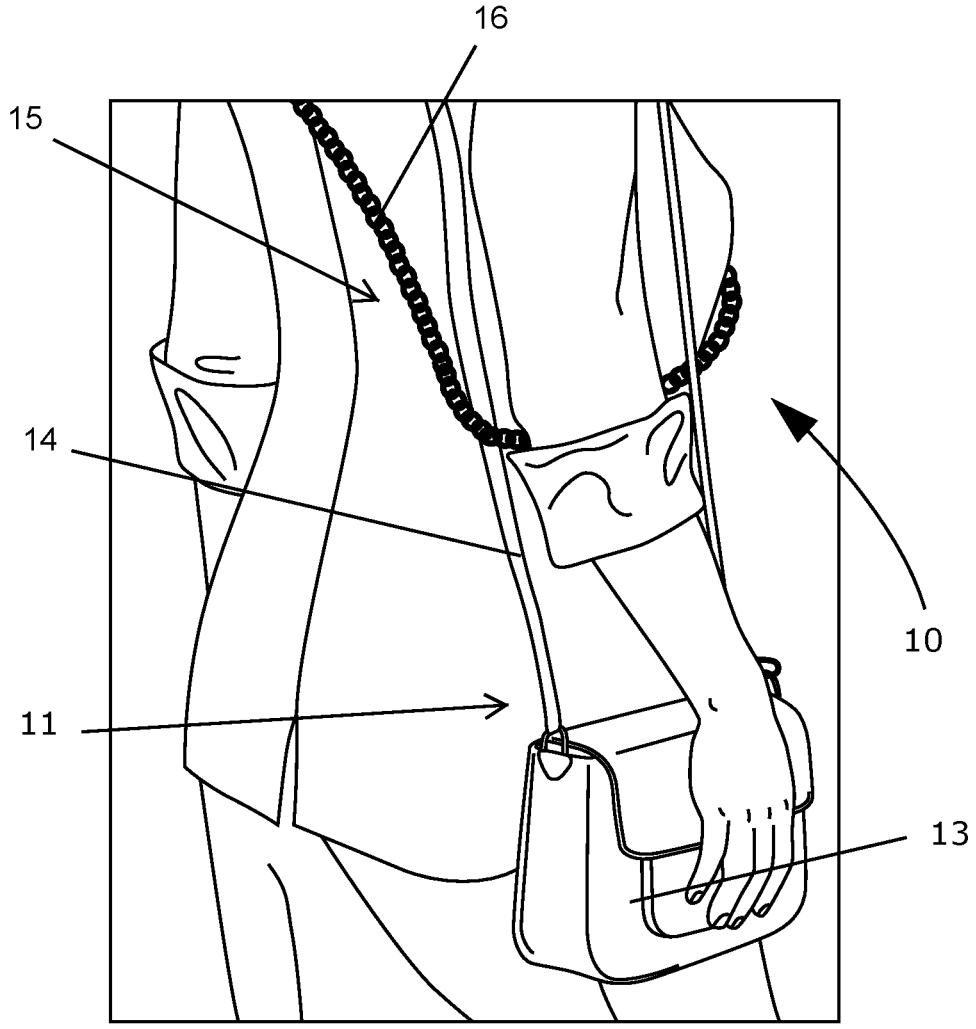
FIG. 1 is a perspective view showing the structural interrelationship between the major components of a combined purse and security fastener, in accordance with a non-limiting exemplary embodiment.
Figure 2:
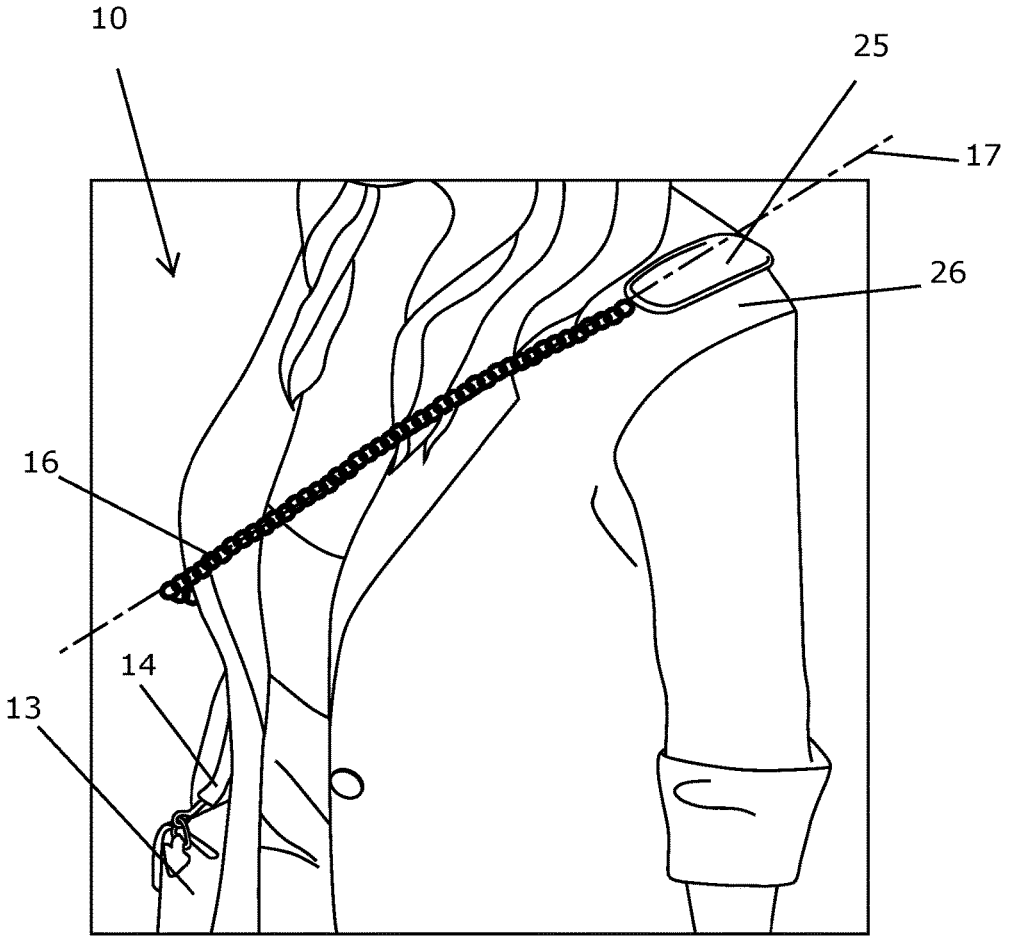
FIG. 2 is another perspective view of the combined purse and security fastener illustrated in FIG. 1.
Figure 3:
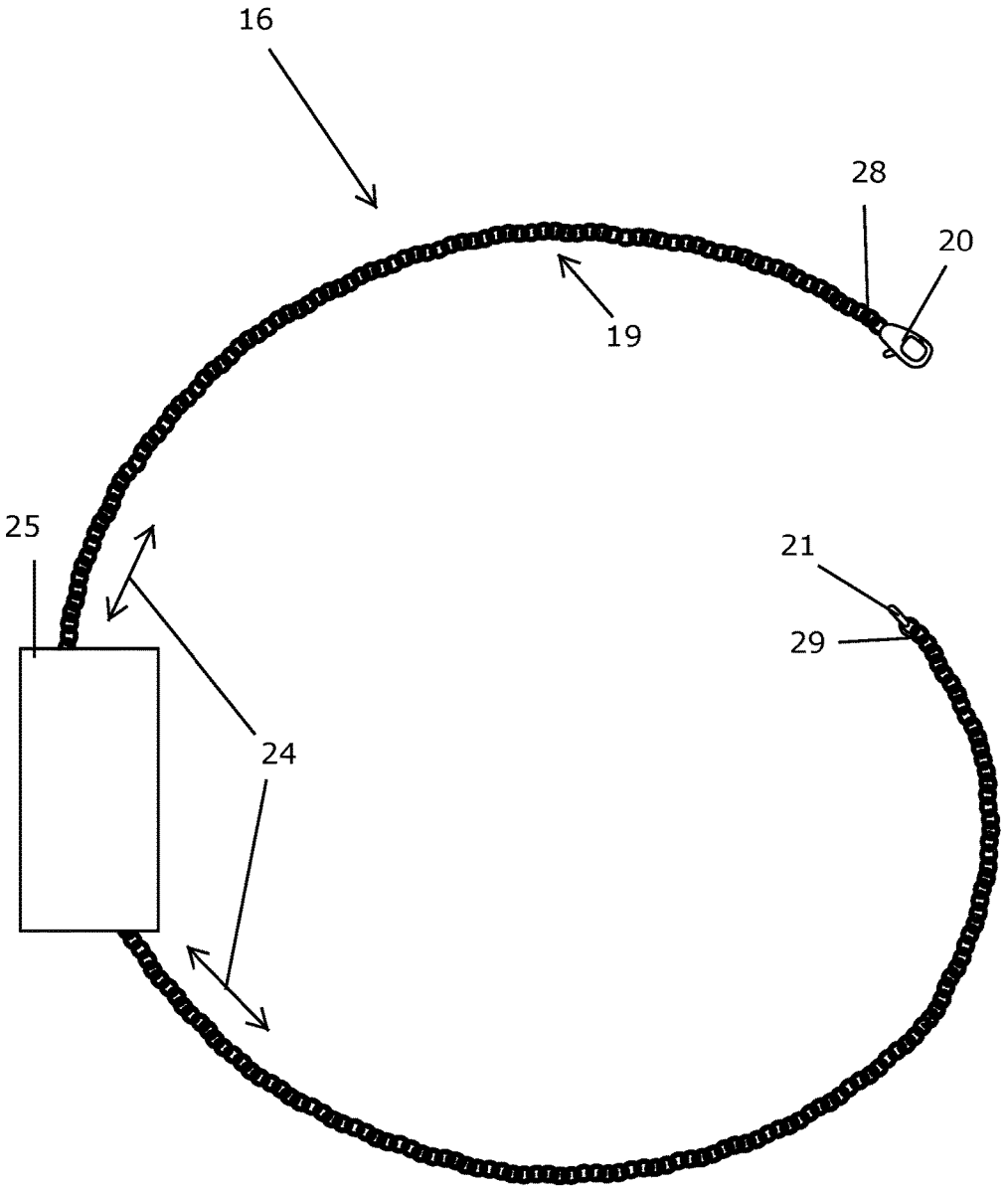
FIG. 3 is a top plan view of the security fastener having a flexible chain and shoulder pad slidably coupled thereto.
Figure 4:
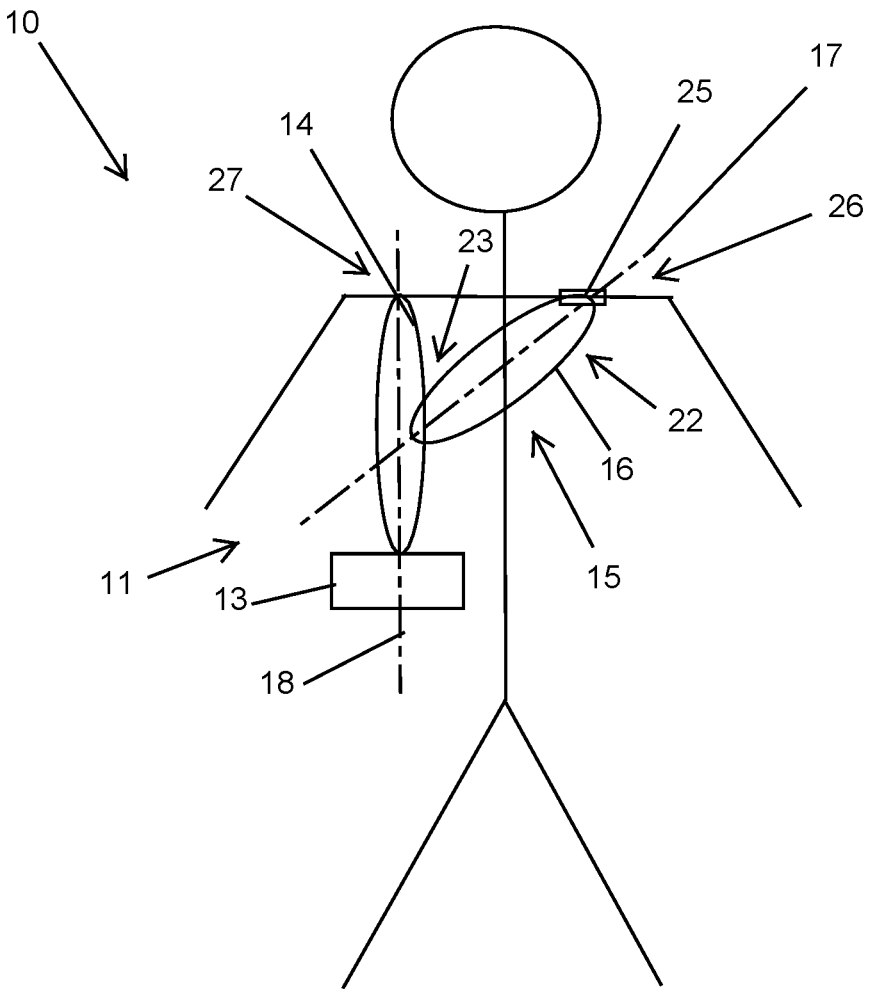
FIG. 4 is a schematic diagram illustrating the orientation of the purse and security fastener disposed along a second axis and a first axis, respectively.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-5 and is/are intended to provide a combined purse and security fastener 10 for securing the purse 11 around a user neck and a user shoulder (e.g., first shoulder 26, second shoulder 27), thus preventing theft of the purse 11, while also affording optimal comfort when carrying the purse 11 over the user shoulder (e.g., first shoulder 26, second shoulder 27). Such a combined purse and security fastener 10 includes a purse 11 including a storage section 13 and a flexible shoulder strap 14 affixed thereto, and a security fastener 15 slidably coupled to the purse 11. Such a security fastener 15 includes a flexible chain 16 and a shoulder pad 25 adjustably engaged with the flexible chain 16. Advantageously, the flexible chain 16 is looped through the flexible shoulder strap 14 and interlinked therewith such that the flexible chain 16 rests along a first axis 17 during use and the flexible shoulder strap 14 rests along a second axis 18 during use. Notably, the first axis 17 intersects the second axis 18 such that the flexible chain 16 overlaps the flexible shoulder strap 14.

In a non-limiting exemplary embodiment, the flexible chain 16 includes a plurality of interlinked rings 19 disposed non-parallel to the flexible shoulder strap 14 during use, a first fastener 20 attached to a proximal end 28 of the interlinked rings 19, and a second fastener 21 attached to a distal end 29 of the interlinked rings 19. Advantageously, the first fastener 20 is releasably engaged with the second fastener 21. Notably, the interlinked rings 19 are configured to form a loop 22 when the first fastener 20 is affixed to the second fastener 21. Thus, if the purse is undesirably pulled away from the first shoulder 26 of the user, the flexible chain 16 prevents the purse 11 from being stolen because the flexible chain 16 is anchored at the second shoulder 27 of the user.

In a non-limiting exemplary embodiment, the second axis 18 is substantially vertical and the first axis 17 is angled approximately 45 degrees (at 23) relative to the second axis 18.

In a non-limiting exemplary embodiment, the shoulder pad 25 is slidably reciprocated in a bidirectional path 24 along a longitudinal length of the interlinked rings 19.

In a non-limiting exemplary embodiment, the first axis 17 passes through the shoulder pad 25 during use.

In a non-limiting exemplary embodiment, the second axis 18 passes through the storage section 13 during use.

Figure 5:
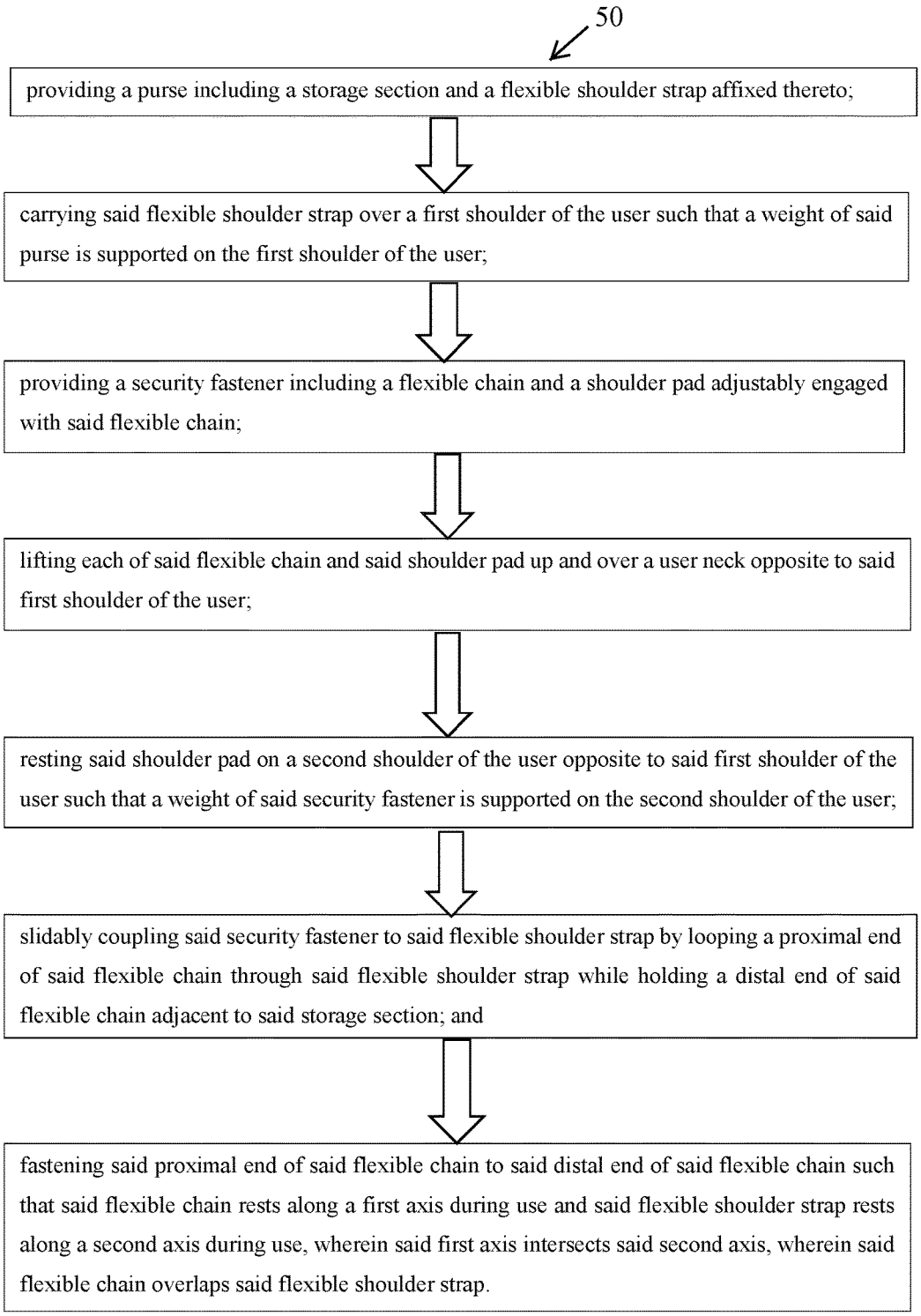
FIG. 5 is a flow chart illustrating the chronological method steps for utilizing a combined purse and security fastener, in accordance with a non-limiting exemplary embodiment of the present disclosure.

As perhaps best shown by process 50 in FIG. 5, the present disclosure further includes a method of utilizing a combined purse and security fastener 10 for securing the purse 11 around a user neck and a user shoulder 12, thus preventing theft of the purse 11, while also affording optimal comfort when carrying the purse 11 over the user shoulder 12. Such a method includes the chronological steps of: providing a purse 11 including a storage section 13 and a flexible shoulder strap 14 affixed thereto; carrying the flexible shoulder strap 14 over a first shoulder 26 of the user such that a weight of the purse 11 is supported on the first shoulder 26 of the user; providing a security fastener 15 including a flexible chain 16 and a shoulder pad 25 adjustably engaged with the flexible chain 16; lifting each of the flexible chain 16 and the shoulder pad 25 up and over a user neck opposite to the first shoulder 26 of the user; and resting the shoulder pad 25 on a second shoulder 27 of the user opposite to the first shoulder 26 of the user such that a weight of the security fastener 15 is supported on the second shoulder 27 of the user.

The method further includes the chronological steps of: slidably coupling the security fastener 15 to the flexible shoulder strap 14 by looping a proximal end 28 of the flexible chain 16 through the flexible shoulder strap 14 while holding a distal end 29 of the flexible chain 16 adjacent to the storage section 13; and fastening the proximal end 28 of the flexible chain 16 to the distal end 29 of the flexible chain 16 such that the flexible chain 16 rests along a first axis 17 during use and the flexible shoulder strap 14 rests along a second axis 18 during use, wherein the first axis 17 intersects the second axis 18, wherein the flexible chain 16 overlaps the flexible shoulder strap 14.

A non-limiting exemplary embodiment(s) of the present disclosure is referred to generally to the figures and is intended to provide a combined purse and security fastener 10 including an integrated, ergonomic sliding shoulder pad 25 for securing the purse's 11 shoulder strap 14 around a user's neck and first shoulder 26, thus effectively preventing theft of these accessories, while also affording optimal comfort when carrying the over the first shoulder 26.

Referring to the figures in general, in a non-limiting exemplary embodiment(s), the security fastener 15 includes an ergonomic chain 16 to be easily secured through the strap 14 of a purse 11 and worn about the neck and first shoulder 26. The security fastener 15 is designed to both prevent a purse 11 snatcher from stealing the purse 11, as well as afford optimal comfort when carrying the purse 11.

In a non-limiting exemplary embodiment, the security fastener 15 includes two main components: a flexible chain 16 and an ergonomic shoulder pad 25. Taken separately, the flexible chain 16 could be manufactured of a linked metal material and is an elongated length of chain 16 sized appropriately to easily wrap over the first shoulder 26 of the user and around the neck, extending through the strap 14 of the purse 11 carried on the opposite shoulder 27. Located on either end 28, 29 of the chain 16 would be a heavy duty interlocking fastener with which to secure the proximal end 28 and distal end 29 of the chain 16 together when threaded (e.g., looped, interlinked) through the actual shoulder strap 14 of the purse 11. This chain 16 could be offered in a variety of metal tones including gold, silver or bronze, as well as neutral black or white.

In a non-limiting exemplary embodiment, wrapped about the chain 16 is the ergonomic shoulder pad 25. Generally rectangular in shape, this wide, elongated shoulder pad 25 may be manufactured of a lofty foam material and configured to rest comfortably over the first shoulder 26 and against the base of the neck. Fully adjustable, this protective shoulder pad 25 is easily slid up and down the chain 16 in order to ensure a customized, comfortable fit during use. A variety of suitable ways can be employed to slidably position pad 25 along chain 16. For example, a channel may be formed in the pad 25, through which chain 16 is loosely passed. As with the chain 16, the cushiony shoulder pad 25 can be offered in understated neutral hues, as well as in striking colors or printed designs.

In a non-limiting exemplary embodiment, application and use of the combined purse and security fastener 10 is very simple and straight forward. First, the user would purchase the combined purse and security fastener 10 in the desired color and metal tone. Sliding the elongated chain 16 through the strap(s) of the purse 11, the user secures the ends 28, 29 of the chain 16 together via its interlocking fasteners 20, 21 located on proximal 28 and distal 29 ends thereof. In this manner, the security fastener 15 provides an elongated, looped holder that runs through the actual shoulder strap 14 of the purse 11. The user slides the strap 14 of the purse 11 up and over the second shoulder 27 as if carrying it in the traditional manner. Next, the user positions the chain 16 and ergonomic shoulder pad 25 over the head, resting it atop the opposite shoulder 26 and thus anchoring the purse 11 and chain 16 to the user body.

The user then slides the adjustable shoulder pad 25 so that it rested over the shoulder 26 and the base of the neck, countering and supporting the weight of the purse 11 and facilitating supreme comfort during use. The combined purse and security fastener 10 is left in place as long as the user carries his/her purse 11, with removal of the security fastener 15 simply involving reversal the aforementioned method steps. As such, the combined purse and security fastener 10 effectively prevents a nefarious individual from snatching one's purse 11 and pulling it off the user's shoulder 27.

The combined purse and security fastener 10 offers consumers a number of significant benefits and advantages. Foremost, the combined purse and security fastener 10 provides consumers a practical means of preventing thieves from snatching their purse 11. A cleverly designed security fastener 15 which runs through (e.g., looped, interlinked) the strap 14 of the purse 11 and is anchored over the user's opposite shoulder 26 and neck. The combined purse and security fastener 10 effectively prevents a thief from pulling a purse 11 off the body and fleeing with this accessory. In this manner, application of the combined purse and security fastener 10 provides users (e.g., females) a peace of mind, while also sparing them the emotional and financial distress associated with a stolen purse. Protecting the user from having their purse 11 stolen, the combined purse and security fastener 10 also offers a simple way in which to enjoy optimal comfort when carrying a heavy purse 11.

Boasting an integrated, generously padded shoulder pad 25 that alleviates the weight of the purse 11 and gently hugs the shoulder 26 and neck, the combined purse and security fastener 10 enables the user to comfortably and safely tote a heavy carryall in a simple and reliable manner. Eliminating the neck and shoulder pain, as well as painful cutting into the skin that can be caused by conventional purse straps, the combined purse and security fastener 10 allows the busy female to carry a heavy purse 11 throughout the day in comfort and with ease.

The combined purse and security fastener 10 is a unique invention which offers consumers a comfortable and secure way in which to transport a purse 11 or other carryall. Functional and fashionable, the disclosure also appeals to men.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A method of utilizing a combined purse and security fastener for securing said purse around a user neck and a user shoulder, thus preventing theft of said purse, while also affording comfort when carrying said purse over the user shoulder, said method comprising the chronological steps of:

providing a purse including a storage section and a flexible shoulder strap affixed thereto;

carrying said flexible shoulder strap over a first shoulder of the user;

providing a security fastener including a flexible chain and a shoulder pad adjustably engaged with said flexible chain;

lifting said flexible chain and said shoulder pad up and over a user neck opposite to said first shoulder of the user;

resting said shoulder pad on a second shoulder of the user opposite to said first shoulder of the user;

slidably coupling said security fastener to said flexible shoulder strap by looping a proximal end of said flexible chain through said flexible shoulder strap; and fastening said proximal end of said flexible chain to said distal end of said flexible chain such that said flexible chain rests along a first axis during use and said flexible shoulder strap rests along a second axis during use, wherein said first axis intersects said second axis, wherein said flexible chain overlaps said flexible shoulder strap.

2. The method of claim 1, wherein said flexible chain comprises:

a plurality of interlinked rings disposed non-parallel to said flexible shoulder strap during use;

a first fastener attached to said proximal end of said interlinked rings; and a second fastener attached to said distal end of said interlinked rings;

wherein said first fastener is releasably engaged with said second fastener;

wherein said interlinked rings are configured to form a loop when said first fastener is affixed to said second fastener.

3. The method of claim 2, wherein said second axis is substantially vertical and said first axis is angled approximately 45 degrees relative to said second axis.

4. The method of claim 3, wherein said shoulder pad is slidably reciprocated in a bidirectional path along a longitudinal length of said interlinked rings.

5. The method of claim 4, wherein said first axis passes through said shoulder pad during use.

6. The method of claim 5, wherein said second axis passes through said storage section during use.

7. A method of utilizing a combined purse and security fastener for securing said purse around a user neck and a user shoulder, thus preventing theft of said purse, while also affording comfort when carrying said purse over the user shoulder, said method comprising the chronological steps of:

providing a purse including a storage section and a flexible shoulder strap affixed thereto;

carrying said flexible shoulder strap over a first shoulder of the user such that a weight of said purse is supported on the first shoulder of the user;

providing a security fastener including a flexible chain and a shoulder pad adjustably engaged with said flexible chain;

lifting each of said flexible chain and said shoulder pad up and over a user neck opposite to said first shoulder of the user;

resting said shoulder pad on a second shoulder of the user opposite to said first shoulder of the user such that a weight of said security fastener is supported on the second shoulder of the user;

slidably coupling said security fastener to said flexible shoulder strap by looping a proximal end of said flexible chain through said flexible shoulder strap while holding a distal end of said flexible chain adjacent to said storage section; and fastening said proximal end of said flexible chain to said distal end of said flexible chain such that said flexible chain rests along a first axis during use and said flexible shoulder strap rests along a second axis during use, wherein said first axis intersects said second axis, wherein said flexible chain overlaps said flexible shoulder strap.

8. The method of claim 7, wherein said flexible chain comprises:

a plurality of interlinked rings disposed non-parallel to said flexible shoulder strap during use;

a first fastener attached to said proximal end of said interlinked rings; and a second fastener attached to said distal end of said interlinked rings;

wherein said first fastener is releasably engaged with said second fastener;

wherein said interlinked rings are configured to form a loop when said first fastener is affixed to said second fastener.

9. The method of claim 8, wherein said second axis is substantially vertical and said first axis is angled approximately 45 degrees relative to said second axis.

10. The method of claim 9, wherein said shoulder pad is slidably reciprocated in a bidirectional path along a longitudinal length of said interlinked rings.

11. The method of claim 10, wherein said first axis passes through said shoulder pad during use.

12. The method of claim 11, wherein said second axis passes through said storage section during use.

* * * * *